US005603642A

United States Patent [19]

Shinji et al.

[11] Patent Number: 5,603,642

[45] Date of Patent: Feb. 18, 1997

[54] REAR HOLDER HAVING A RELEASING HOLE WHICH EXTENDS BEYOND A REAR END OF A CONNECTOR HOUSING

[75] Inventors: Yasuhisa Shinji; Kazuhiro Morishita, both of Shizuoka, Japan

[73] Assignee: Yazaki Corporation, Tokyo, Japan

[21] Appl. No.: 396,782

[22] Filed: Mar. 1, 1995

[30] Foreign Application Priority Data

Mar. 3, 1994 [JP] Japan ..... 6-033666

[51] Int. Cl.[6] ..... H01R 13/514

[52] U.S. Cl. ..... 439/752; 439/923; 439/731; 439/940

[58] Field of Search ..... 439/752, 923, 439/696, 701, 940; 174/48, 66, 67, 135; 220/284–286

[56] References Cited

U.S. PATENT DOCUMENTS 4,918,513 5/1990 Kurose et al. ..... 439/71
5,346,414 9/1994 Sakai et al. ..... 439/752

FOREIGN PATENT DOCUMENTS

14688/28 7/1928 Australia ..... 220/284

*Primary Examiner*—Neil Abrams
*Assistant Examiner*—Brian J. Biggi
*Attorney, Agent, or Firm*—Sughrue, Mion, Zinn, Macpeak & Seas

[57] ABSTRACT

A flat rectangular rear holder having groovelike wire inserting parts and a thickness. On a side surface of the rear holder are retaining projections for retaining a housing and a releasing hole for inserting a releasing jig. The rear holder is engaged with the housing that has a plurality of terminal accommodating chambers on a rear end thereof and retaining holes corresponding to the retaining projections along the peripheral wall thereof. With the rear holder engaged with and retained by the housing, an upper end part of the rear holder is projected from the rear end of the housing, so that the upper part of the releasing hole is exposed. This exposed part has an opening area so large as to allow a rear holder releasing jig to be inserted thereinto.

8 Claims, 6 Drawing Sheets

REAR HOLDER HAVING A RELEASING HOLE WHICH EXTENDS BEYOND A REAR END OF A CONNECTOR HOUSING

BACKGROUND OF THE INVENTION

1. Field of the invention

The invention relates to a rear holder that prevents a connection terminal inserted into a connector housing (hereinafter referred to simply as "housing") from coming off the rear end of the housing, the connector housing being used for connecting an electrical wiring system of an automobile or the like. More particularly, the invention is directed to a rear holder structure adapted for the operation of releasing the rear holder during maintenance.

2. Related art

Various connectors used for the connection of wire harnesses in an electrical system of an automobile or the like are designed such that a rear holder is engaged with the rear end of the housing so as to prevent a wired connection terminal accommodated within the housing from coming off or being displaced due to externally applied impact and the like. That is, the rear holder is engaged with the rear end of the housing after the wired connection terminal has been accommodated in the housing, so that the connection terminal is doubly retained from the rear as well. A conventional example having such a doubly retained mechanism is shown in FIG. 10.

As shown in FIGS. 10 and 11, a rectangular rear holder 51 has retaining projections 53 on the side surface, and is engaged with a housing 30 having retaining holes 31 on the rear end. A conventional procedure for releasing the rear holder 51 from the housing 30 using a rear holder releasing jig 20 during maintenance will hereunder be described.

The plurality of retaining projections 53 provided on the side surface of the rear holder 51 are retained by the plurality of retaining holes 31 provided on the rear end of the housing 30. As a result, the rear holder 51 is engaged with and held by the housing 30. That is, the rear holder 51 is engaged with the housing 30 without being projected from the rear end of the housing 30.

Further, as shown in FIGS. 10 and 11, in order to disengage the rear holder 51 from the housing 30, a rear holder releasing jig 20 is used to release the retaining projections 53 from the retaining holes 31 of the housing 30 one by one. That is, the rear holder releasing jig 20 is inserted into a clearance between the housing 30 and the rear holder 51 which are engaged with each other, and force is then applied in a direction D to remove the rear holder 51 from the housing 30.

FIG. 12 is a perspective view showing a state in which the retainment of the rear holder 51 has been released from the housing 30.

However, the aforementioned conventional releasing method suffers from the problem that the retaining projections 53 and the retaining holes 31 on the side of the housing 30 are damaged by the releasing jig since the operation of releasing the retainment is performed by locally applying force to the retaining projections made of a low-hardness resin using a sharp-edged releasing jig made of metal. In addition, when there is a large number of retainment projections much time is required for complete removal of the rear holder from the housing, which in turn has impaired impairs maintenance operability.

SUMMARY OF THE INVENTION

The invention has been made to overcome the above problems. Accordingly, the object of the invention is to provide a rear holder capable not only of facilitating the operation of releasing the rear holder at the time of maintenance, but also of improving durability by preventing damage to the connector housing encountered during the releasing operation.

To achieve the above object, a first aspect of the invention is applied to a rear holder having a wire inserting part in a direction of engagement thereof with a connector housing and a retaining projection on a side surface thereof, and being engaged with the connector housing with the retaining projection retained by a retaining hole provided on the connector housing, so that the rear holder prevents a connection terminal inserted into the connector housing from coming off a rear end of the connector housing, wherein a releasing hole allowing an operating part of a releasing jig to be inserted thereinto is provided on the side surface of the rear holder, so that when the rear older is retained by the connector housing, at least a part of the releasing hole is exposed from the rear end of the connector housing.

To achieve the above object, a second aspect of the invention is applied to a rear holder wherein a thickness of the rear holder is set to such a value as to allow at least the part of the releasing hole to be exposed from the rear end of the connector housing when the rear holder is retained by the connector housing.

To achieve the above object, a third aspect of the invention is applied to a rear holder comprising: a rear holder main body having a wire inserting part in a direction of engagement thereof with a connector housing and a retaining projection on a side surface thereof, the retaining projection being retained by a retaining hole provided on the connector housing; and a pair of rear covers coupled integrally with the rear holder main body, so that the rear holder prevents a connection terminal inserted into the connector housing from coming off a rear end of the connector housing, wherein a releasing hole allowing an operating part of a releasing jig to be inserted thereinto is provided on the side surface of the rear holder main body, so that when the rear older main body is retained by the connector housing, at least a part of the releasing hole is exposed from the rear end of the connector housing.

To achieve the above object, a fourth aspect of the invention is applied to a rear holder wherein a thickness of the rear holder main body is set to such a value as to allow at least the part of the releasing hole to be exposed from the rear end of the connector housing when the rear holder main body is retained by the connector housing, and a width of each of hinges coupling the rear covers is set to a large value so as to correspond to the thickness of the rear holder main body.

The rear holder of the invention is provided as arranging such a releasing hole as to allow the operating part of the releasing jig to be inserted thereinto on the side surface of the rear holder and thereby allowing at least a part of the releasing hole to be exposed from the rear end of the housing when the rear holder is retained by the housing.

Therefore, in the operation of removing the rear holder from the housing, the operating part of the releasing jig can be inserted into the releasing hole with ease, and in addition, the retainment of the rear holder can be released at a time by turning the releasing jig in the releasing direction.

Further, the rear holder of the invention is also provided as setting the thickness of the rear holder to such a value as to allow at least a part of the releasing hole to be exposed from the rear end of the housing when the rear holder is engaged with the housing.

Therefore, not only the releasing hole can be exposed without manually handling the housing, but also the formation of the releasing hole contributes to lightening the inside of the rear holder, which in turn prevents shrinkage cavity, warpage, and the like of the rear holder due to the increased thickness.

Still further, the rear holder of the invention is also provided as arranging such a releasing hole as to allow the operating part of the releasing jig to be inserted thereinto on the side surface of the rear holder main body and thereby allowing at least a part of the releasing hole to be exposed from the rear end of the housing when the rear holder main body is retained by the housing.

Therefore, in the operation of removing the rear holder from the housing, the operating part of the releasing jig can be inserted into the releasing hole with ease. In addition, the retainment of the rear holder can be released at a time by turning the releasing jig in the releasing direction, and therefore the rear covers and the like in no way hinder the releasing operation.

Still further, the rear holder of the invention is also provided not only as setting the thickness of the rear holder to such a value as to allow at least a part of the releasing hole to be exposed from the rear end of the housing when the rear holder is engaged with the housing, but also as setting the width of the hinge coupling the rear cover to a correspondingly large value.

Therefore, not only the releasing hole can be exposed without manually handling the housing, but also the forming of the releasing hole contributes to lightening the inside of the rear holder, which in turn prevents shrinkage cavity, warpage, and the like of the rear holder due to the increased thickness.

Still further, the reinforcement of the hinges contributes to improving durability of the rear holder.

DETAILED DESCRIPTION OF THE PREFERRED EMBODIMENTS

A rear holder, which is a first embodiment of the invention, will now be described with reference to FIGS. 1 to 6.

Figure 1:
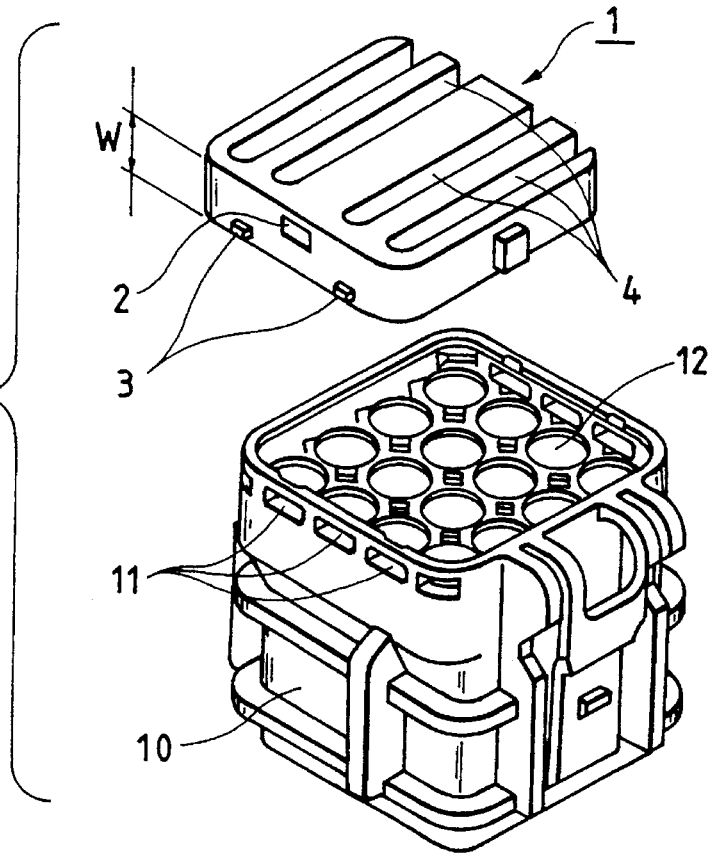
FIG. 1 is an exploded perspective view of a rear holder, which is a first embodiment of the invention.

As shown in FIG. 1, a rear holder 1, which is the first embodiment of the invention, is a rectangular flat member having groovelike wire inserting parts 4 and a thickness of w. On a side surface are retaining projections 3 for retaining a housing 10 and a releasing hole 2 for inserting a releasing jig. The housing 10 will be described later. This rear holder 1 is engaged with the housing 10 that has a plurality of terminal accommodating chambers 12 on the rear end thereof and retaining holes 11 corresponding to the retaining projections 3 along the peripheral wall thereof.

Figure 2:
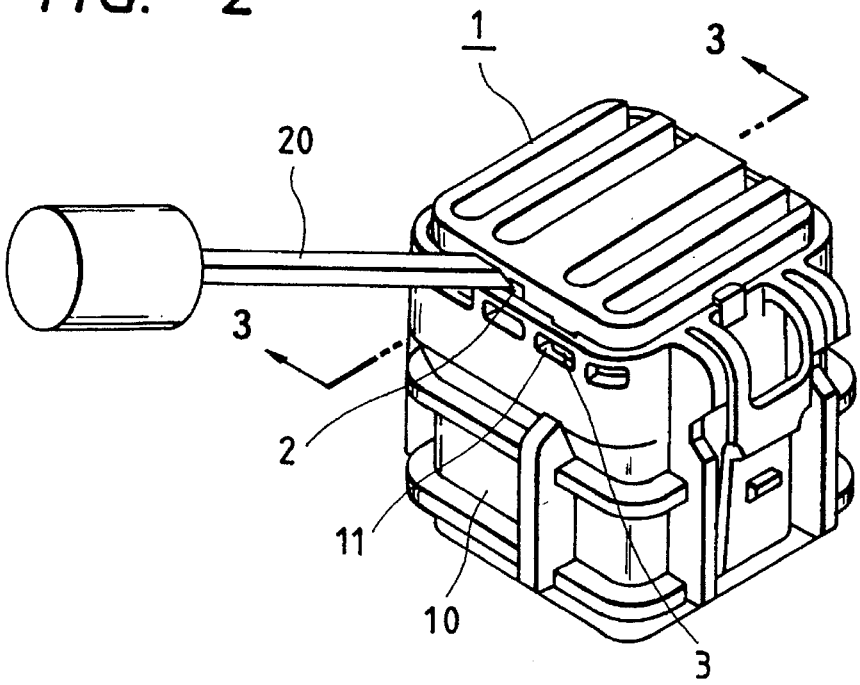
FIG. 2 is a perspective view showing an initial state of the operation of releasing the rear holder of FIG. 1 that is engaged.

As shown in FIG. 2, with the rear holder 1 engaged with and retained by the housing 10, the upper end part of the rear holder 1 is projected from the rear end of the housing 10, so that the upper part of the releasing hole 2 is exposed. This exposed part has an opening area so large as to allow a rear holder releasing jig 20 to be inserted thereinton.

Figure 3:
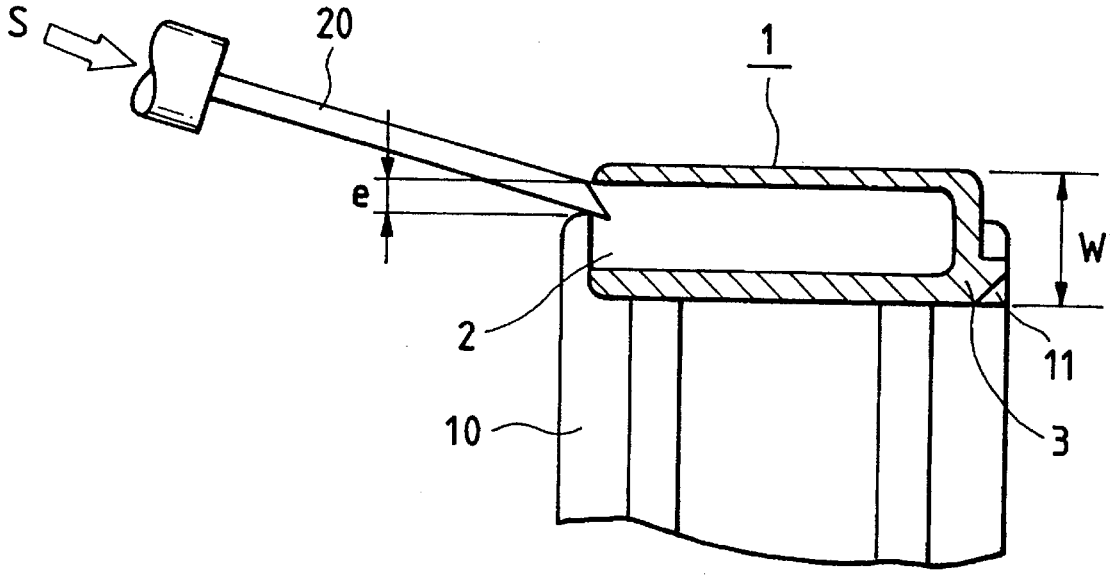
FIG. 3 is a sectional view taken along a line 3—3 in FIG. 2.

As shown in FIG. 3, the rear holder 1 and the housing 10 are engaged with each other, with the retaining projection 3 of the rear holder 1 being retained by the retaining hole 11 of the housing 10. The thickness w of the rear holder 1 is set to a value larger than that of the conventional example so that the rear holder can be projected from the rear end of the housing 10. Therefore, the upper part of the releasing hole 2 bored inward from the rear holder 1 side surface is exposed from the rear end of the housing 10 as an exposed part e.

An operating part of the rear holder releasing jig 20 is inserted into the releasing hole 2 from this exposed part e with small insertion force in a direction S, so that the operation of releasing the rear holder 1 from the housing 10 is started.

Figure 4:
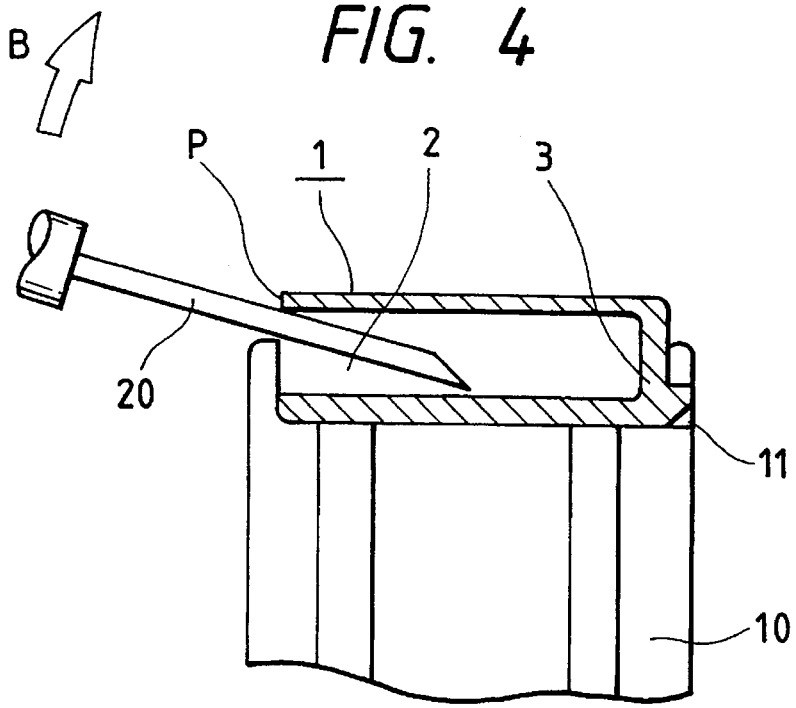
FIG. 4 is a sectional view showing an intermediate state of the releasing operation of FIG. 2.

As shown in FIG. 4, the rear holder releasing jig 20 is further inserted into the depth of the releasing hole 2. Then, when the rear holder releasing jig 20 is turned in a direction B, the operating part of the releasing jig comes in contact with the upper end of the entrance of the releasing hole 2. As the rear holder releasing jig 20 is further turned with this point of contact as a pivot P, strong releasing force is applied to the rear holder 1 through the pivot P.

Figure 5:
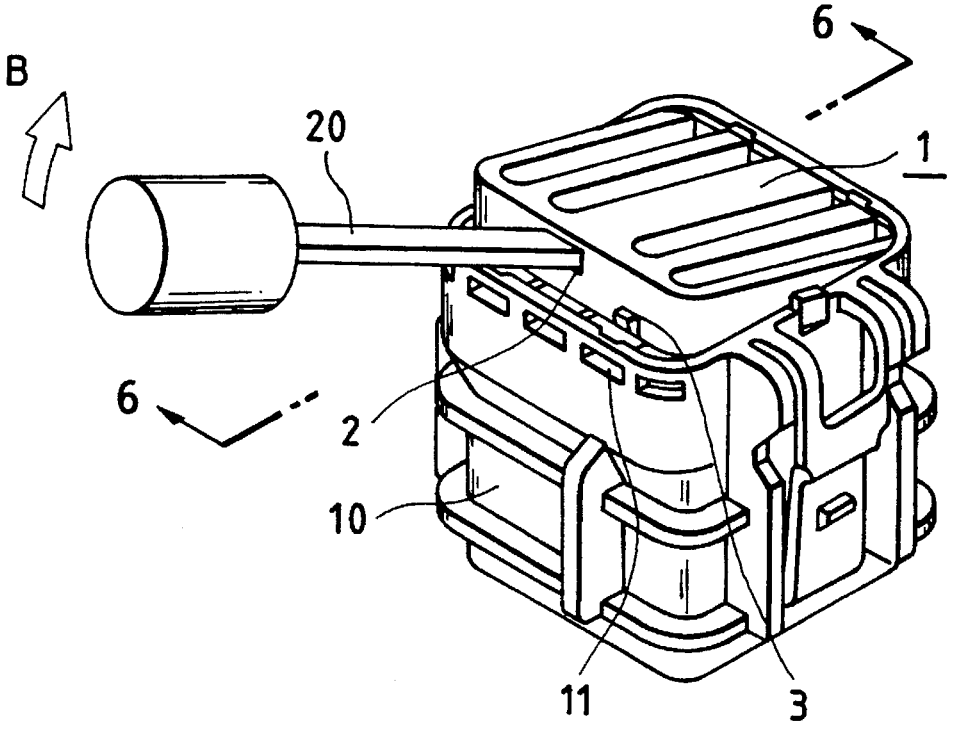
FIG. 5 is a perspective view showing a state of the rear holder of FIG. 2 that is released.
Figure 6:
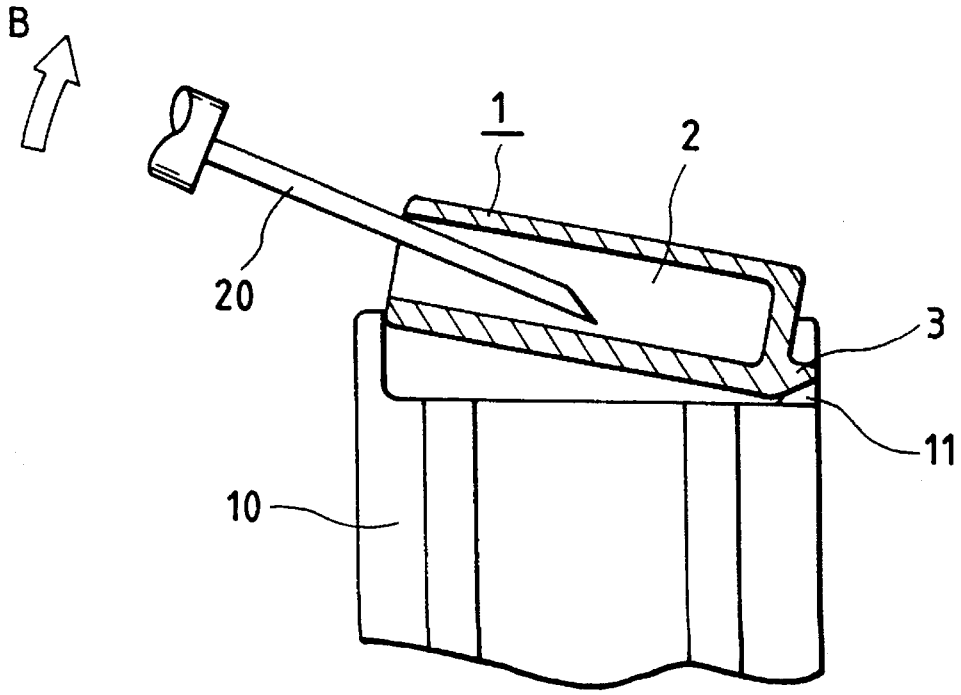
FIG. 6 is a sectional view taken along a line 6—6 in FIG.

Hence, as shown in FIGS. 5 and 6, the retaining projection 3 comes off the retaining hole 11, so that the rear holder 1 is released from the housing 10 with ease by a single round of releasing operation.

As described above, the rear holder 1, which is the first embodiment of the invention, has the thickness thereof set to a value larger than that of the conventional example so that at least a part of the releasing hole 2 is exposed from the rear end of the housing 10 when the rear holder 1 is engaged with the housing 10.

As a result of this construction, the rear holder releasing jig 20 can be inserted with small inserting force, thereby allowing the rear holder 1 in the retained state to be released from the housing 10 at a time.

Hence, even if the rear holder is retained at many positions of the housing 10, the rear holder 1 can be removed with a single round of releasing operation.

In addition, since the releasing operation is performed by inserting the rear holder releasing jig 20 into the releasing hole 2, damage often given to the retaining projections 3 or to the retaining hole 11 during the rear holder 1 releasing operation can be minimized.

Further, the releasing hole 2 formed on the side surface of the rear holder 1 amounts, so to speak, to lightening the inside of the rear holder 1, thereby preventing shrinkage cavity, warpage, and the like from occurring during the molding of the rear holder.

Figure 7:
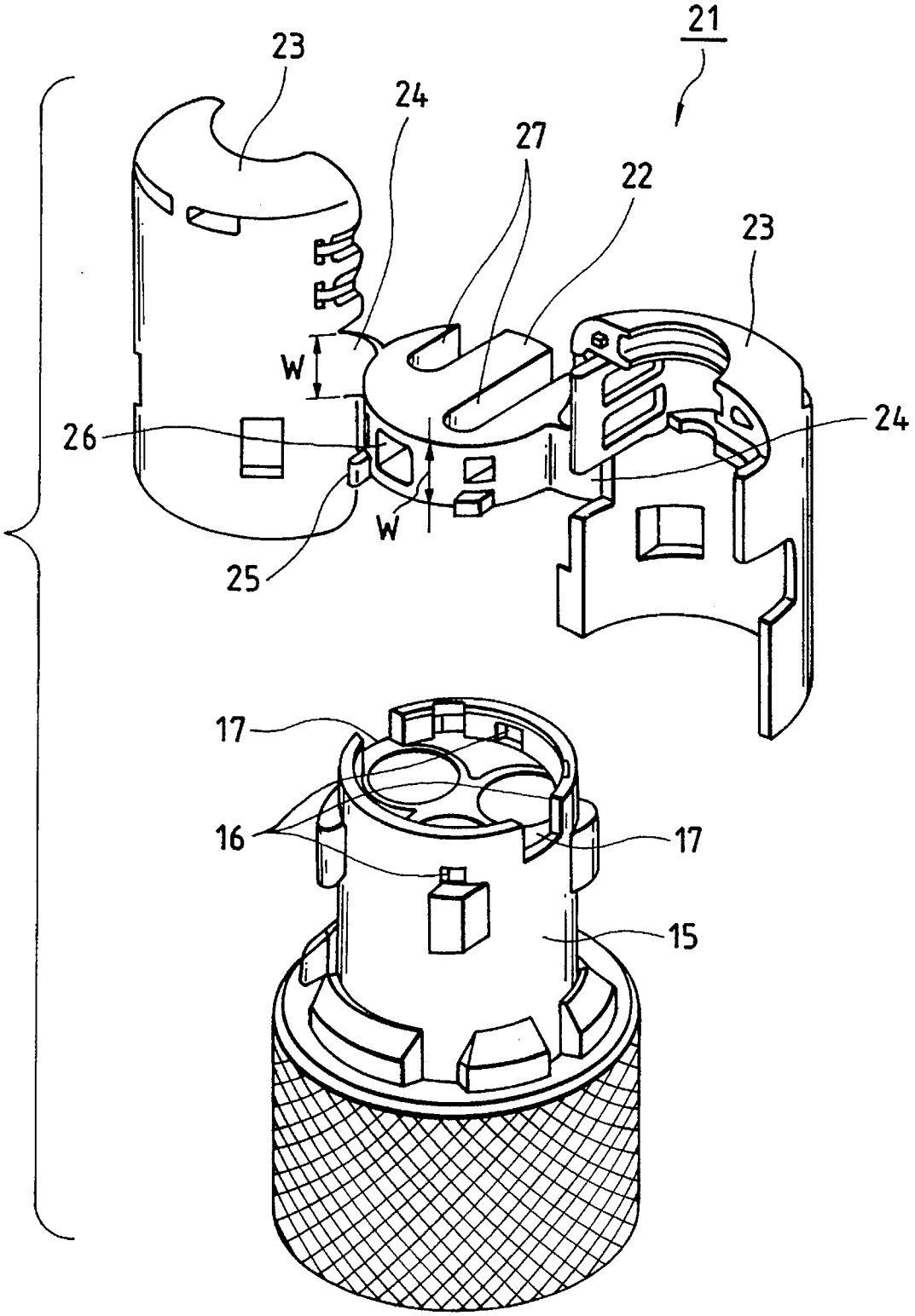
FIG. 7 is an exploded perspective view of a rear holder, which is a second embodiment of the invention.

A rear holder, which is a second embodiment of the invention, will be described next with reference to FIGS. 7 and 8. FIG. 7 is an exploded perspective view of a rear holder, which is the second embodiment of the invention; and FIG. 8 is a perspective view showing an initial state of the operation of releasing the rear holder of FIG. 7 that is engaged.

As shown in FIG. 7, a rear holder 21 includes: a rear holder main body 22 and a pair of rear covers 23, 23. The rear holder main body 22 has a plurality of groovelike wire inserting parts 27 in a direction of engagement, and the pair of rear covers 23 are integrally coupled by hinges 24 with the rear holder main body 22. On the side surface of the rear holder main body 22 are a plurality of retaining projections 25 and a releasing hole 26 bored toward the inside of the rear holder main body 22.

Further, on the side of a housing 15 are a plurality of retaining holes 16 and hinge inserting notches 17, 17 into which the hinges 24 are inserted. These retaining holes 16 and the hinge inserting notches 17 are arranged on the rear end of the housing 15 (the upper end as viewed in FIG. 7).

Figure 8:
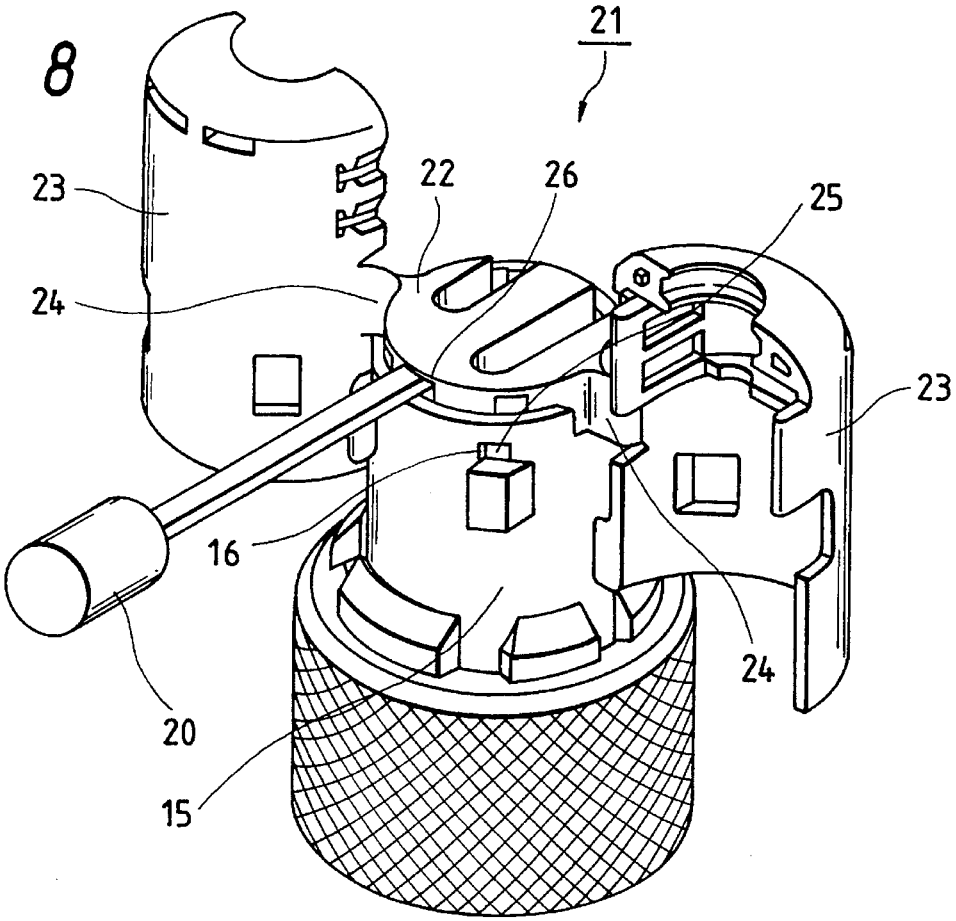
FIG. 8 is a perspective view showing an initial state of the operation of releasing the rear holder of FIG. 7 that is engaged.

As shown in FIG. 8, the plurality of retaining projections 25 provided on the side surface of the rear holder main body 22 of the rear holder 21 are retained by the plurality of retaining holes 16 on the housing 15 with the rear holder 21 engaged with and retained by the housing 15.

In the case of removing the rear holder 21 from the housing 15 by releasing the engagement of the rear holder 21 with the housing 15, the rear holder releasing jig 20 is inserted into the releasing hole 26 of the rear holder main body 22, so that the releasing operation is started.

In a manner similar to the first embodiment, the rear holder main body 22 of the rear holder 21 is projected from the rear end of the housing 15 when the rear holder 21 is engaged with the housing 15 so as to facilitate insertion of the rear holder releasing jig 20 into the releasing hole 26. That is, at least the upper part of the releasing hole 26 arranged on the side surface of the rear holder main body 22 is exposed. It may be noted that the exposed area must be so large as to allow the operating part of the rear holder releasing jig 20 to be inserted thereinto.

To have the upper part of the releasing hole 26 exposed, the rear holder 21, which is the second embodiment of the invention, is provided not only as setting the thickness of the rear holder main body 22 to a large value only at the part to be exposed, but also as optimizing the location of the retaining projections 25 and the releasing hole 26.

The increased thickness of the rear holder main body 22 may likely cause shrinkage cavity, warpage, and the like at the time of molding the rear holder 21. However, the rear holder 21 according to the second embodiment of the invention can prevent occurrence of the shrinkage cavity, warpage, and the like at the time of molding the rear holder since the forming of the releasing hole 26 on the side surface of the rear holder main body 22 amounts, so to speak, to lightening the inside of the rear holder.

Further, as shown in FIG. 7, the rear holder 21, which is the second embodiment of the invention, is also provided as allowing the width of the hinge 24 to be maximized to a value as thick as the rear holder main body 22 so as to correspond to the thickness w of the rear holder main body 22. Therefore, the bending resistance of the hinges 24, 24 can be improved, which in turn contributes to significantly improving durability of the hinges 24, 24 with respect to the opening and closing operation of the rear covers 23, 23 and thus increasing durability of the rear holder 21.

Figure 9:
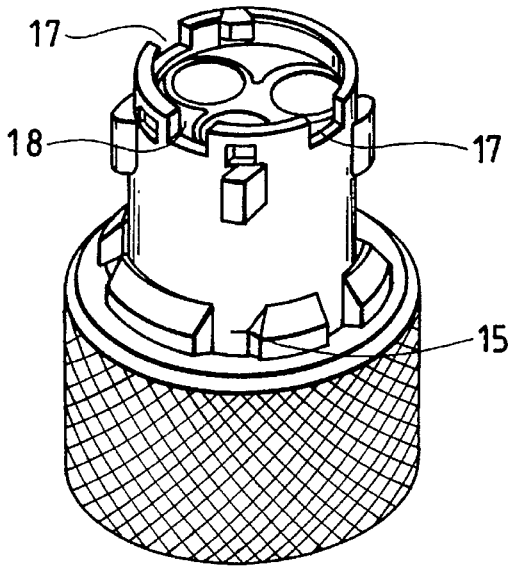
FIG. 9 is a perspective view of the side of a housing, which is a modified example of the second embodiment.
Figure 10:
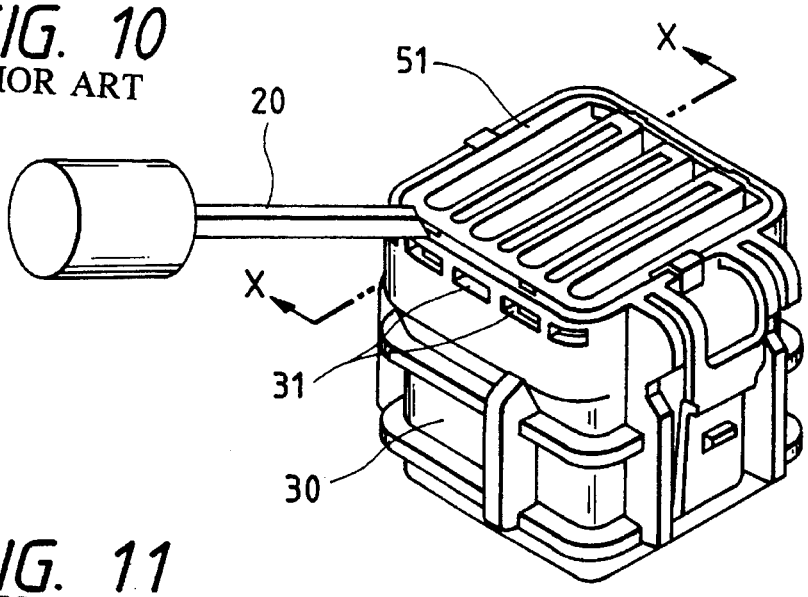
FIG. 10 PRIOR ART
FIG. 10 is a perspective view showing an initial state of the operation of releasing a conventional rear holder that is engaged.
Figure 11:
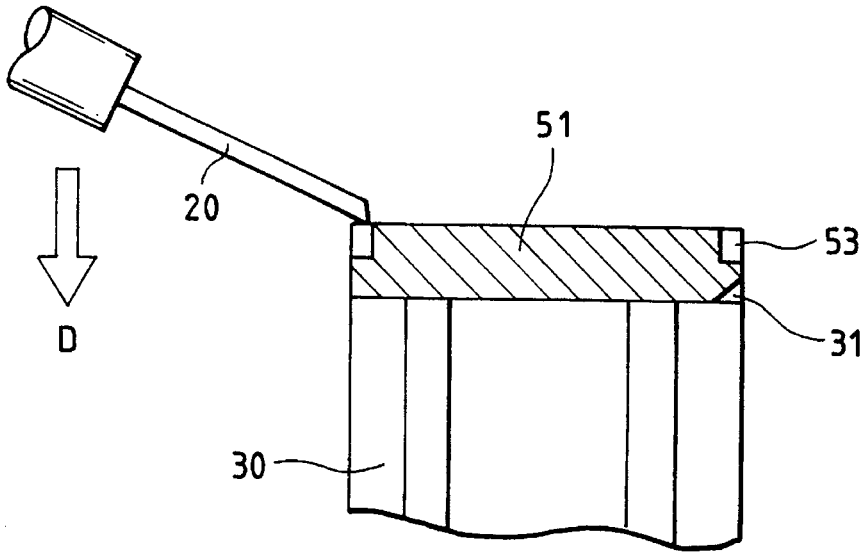
FIG. 11 PRIOR ART
FIG. 11 is a sectional view taken along a line 11—11 in FIG. 10.
Figure 12:
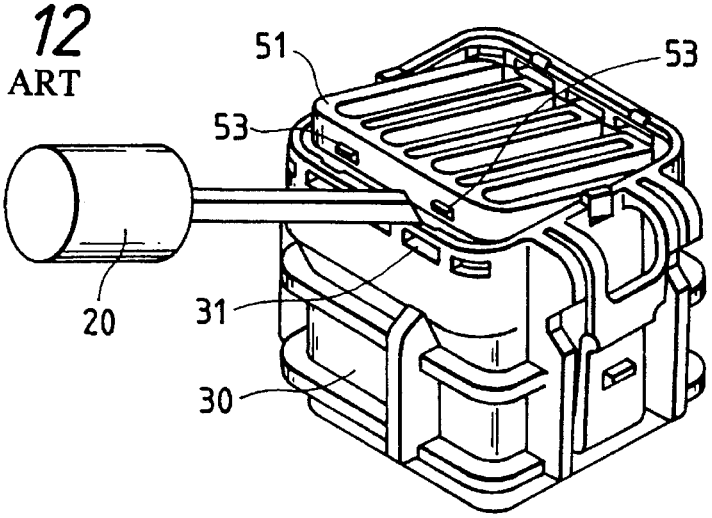
FIG. 12 PRIOR ART
FIG. 12 is a perspective view showing an initial state of the rear holder of FIG. 10.

Furthermore, to reserve a larger exposed area of the releasing hole 26, e.g., a jig inserting notch 18 may be provided on the rear end of the housing 15 separately from the hinge inserting notches 17, 17 as shown in FIG. 9. As a result of this construction, the operation of inserting the rear holder releasing jig 20 into the releasing hole 26 is facilitated, thereby further improving operability at the time of maintenance.

As described in the foregoing, the rear holder of the invention is provided not only as allowing the rear holder to be projected from the rear end of the housing by setting the thickness of the rear holder to a large value, but also as forming a releasing jig inserting hole, which is equivalent to the lightening of the rear holder on the side surface of the rear holder so that at least the upper part of the releasing hole can be exposed when the rear holder is engaged with the housing.

Therefore, not only the releasing jig can be inserted into the releasing hole with ease, but also the retainment of the rear holder can be released reliably by a single round of releasing operation even if the rear holder is retained by the housing at many locations, thereby remarkably improving operability.

In addition, the operating part of the releasing jig is not likely to operate on the retaining projections of the rear holder and on the retaining hole of the housing directly, thereby eliminating damage conventionally often caused to the retaining projections or to the retaining hole.

As a result, not only durability of the retaining parts of the rear holder, the housing, and the like can be remarkably improved, but also parts loss can be significantly reduced since the parts can be reused repetitivel Still further, not only the thickness of the rear holder is set to a large value, but also the releasing hole formed on the side surface serves as lightening, which in turn reliably prevents shrinkage cavity, warpage, and the like caused at the time of molding the rear holder.

Still further, with respect to the rear holder having the rear covers, the thickness of the hinge can also be set to a large value so as to correspond to the increase in the thickness of the rear holder, which not only improves the life of the hinge but also significantly ameliorates durability of the rear holder.

What is claimed is:

1. A connector comprising:

a connector housing provided with a retaining hole;

a rear holder including:

a wire inserting part;

a retaining projection on a side surface of the rear holder for engaging the rear holder with the connector housing, wherein the retaining projection is retained by the retaining hole provided on the connector housing, so that the rear holder prevents a connection terminal inserted into the connector housing from coming off a rear end of the connector housing; and a releasing hole for allowing an operation part of a releasing jig to be inserted thereinto, the releasing hole being provided on the side surface of the rear holder and extending into an interior portion of the rear holder and having an exposed part which extends beyond the rear end of the connector housing when the rear holder is retained by the connector housing.

2. A rear holder as claimed in claim 1, wherein a thickness of the rear holder is set to such a value as to allow the exposed part of the releasing hole to extend the rear end of the connector housing when the rear holder is retained by the connector housing.

3. A connector as claimed in claim 1, further comprising:

a pair of rear covers coupled integrally with the rear holder.

4. A connector as claimed in claim 3, wherein a thickness of the rear holder is set to such a value as to allow the exposed part of the releasing hole to extend beyond the rear end of the connector housing when the rear holder is retained by the connector housing, and a width of each of hinges coupling the rear covers to the rear holder is set to a predetermined value so as to correspond to the thickness of the rear holder.

5. A connector as claimed in claim 4 further comprising a jig inserting notch provided on a rear end of the connector housing, and hinge inserting notches provided on the side surface of the connector housing, wherein said jig inserting notch is disposed separate from said hinge inserting notches.

6. A connector as claimed in claim 1, wherein a jig inserting notch is provided on the rear end of the housing.

7. A connector comprising:

a connector housing provided with a retaining hole;

a rear holder including:

a wire inserting part;

a retaining projection on a side surface of the rear holder for engaging the rear holder with the connector housing, wherein the retaining projection is retained by the retaining hole provided on the connector housing, so that the rear holder prevents a connection terminal inserted into the connector housing from coming off a rear end of the connector housing;

a releasing hole for allowing an operation part of a releasing jig to be inserted thereinto, the releasing hole being provided on the side surface of the rear holder, and having an exposed part which extends beyond the rear end of the connector housing when the rear holder is retained by the connector housing; and a pair of rear covers coupled integrally with the rear holder.

8. A connector as claimed in claim 7, wherein a thickness of the rear holder is set to such a value as to allow the exposed part of the releasing hole to extend beyond the rear end of the connector housing when the rear holder is retained by the connector housing, and a width of each of hinges coupling the rear covers to the rear holder is set to a predetermined value so as to correspond to the thickness of the rear holder.

* * * * *